United States Patent [19]

Böder

[11] Patent Number: 4,736,908

[45] Date of Patent: Apr. 12, 1988

[54] MISSILE GUIDE ASSEMBLY HAVING FOLDABLE FINS

[75] Inventor: Dieter Böder, Düsseldorf, Fed. Rep. of Germany

[73] Assignee: Rheinmetall GmbH, Düsseldorf, Fed. Rep. of Germany

[21] Appl. No.: 58,937

[22] Filed: Jun. 5, 1987

[30] Foreign Application Priority Data

Jun. 5, 1986 [DE] Fed. Rep. of Germany ..... 3618958

[51] Int. Cl.[4] ..... F42B 13/37

[52] U.S. Cl. ..... 244/3.29

[58] Field of Search ..... 244/3.29, 3.23, 3.28

[56] References Cited

U.S. PATENT DOCUMENTS

| | | | |
|---|---|---|---|
| 2,923,241 | 2/1960 | House | 244/3.29 |
| 3,103,886 | 9/1963 | Popenoe | 244/3.29 |
| 3,360,216 | 12/1967 | Schwesig | 244/3.29 |

FOREIGN PATENT DOCUMENTS

| | | | |
|---|---|---|---|
| 3533994 | 4/1986 | Fed. Rep. of Germany . | |
| WO86/02154 | 4/1986 | PCT Int'l Appl. | 244/3.29 X |
| 745252 | 2/1956 | United Kingdom | 244/3.29 X |

*Primary Examiner*—Charles T. Jordan
*Assistant Examiner*—Michael J. Carone
*Attorney, Agent, or Firm*—Spencer & Frank

[57] ABSTRACT

A fin of a missile or projectile which can be folded and unfolded in a space saving manner and which is composed of two fin blades which are connected to one another at their tips and are fastened at their roots to respective different bearings. One of the bearings is an articulated fixed bearing, while the second bearing is an articulated slide guide bearing which slides in a groove. This groove is oriented so that in the collapsed or folded state, the fixed bearing and the slide guide bearing are arranged one behind the other in the circumferential direction, and so that with increasing distance from the fixed bearing, the slide guide bearing will be at an ever greater distance from the center axis of the missile and cause the fin blades, in the unfolded state, to have a symmetrical configuration relative to the respective fin axis outside of the periphery of the missile.

3 Claims, 3 Drawing Sheets

MISSILE GUIDE ASSEMBLY HAVING FOLDABLE FINS

BACKGROUND OF THE INVENTION

The present invention relates to a guide assembly which is of the type having a plurality of foldable fins for projectiles and missiles. More particularly, the present invention relates to a guide assembly having a plurality of fins which are foldable and unfoldable in the circumferential direction and wherein each fin comprises two fin blades whose tips are connected with one another and whose roots are fastened to separate bearings, which are mounted on the guide assembly and whose circumferential spacing is variable in such a manner that, in the unfolded state of the fins, the fin blades are arranged in the manner of a peaked roof, and the bearings are composed of an articulated fixed bearing and an articulated slide guide bearing, with the slide guide bearing being disposed so as to move in a groove.

Such guide assemblies, which are employed particularly for secondary ammunition elements ejected from carrier projectiles over the target area, are disclosed, for example, in International patent publication No. WO 84/02154 (international Ser. No. PCT/EP085/00452). In order for all of the fin blades to have the same length when unfolded and to be arranged in symmetry, the slide bearing in these prior art guide assemblies is of such construction that it is interrupted in its center region to accommodate the fin root of the second fin blade with its fixed bearing when the fins are collapsed or folded. When seen in the axial direction of the projectile or missile, the fixed bearing and the slide bearing thus are congruent, i.e., coaxial, in the collapsed state of the fin. The drawback of such a structure is primarily the complicated and expensive configuration of the bearings.

British patent No. 745,252 discloses a guide assembly in which the fixed bearing and the slide guide bearing are arranged one behind the other, i.e., adjacent, when seen in the circumferential direction of the missile, when the fin is in the folded or collapsed state. The sliding movement of the slide guide bearing during unfolding of the fins blades occurs concentrically with the center or longitudinal axis of the missile. The drawback of such a guide assembly is the fact that after the fin blades have unfolded, they are inclined toward one side and therefore have different stability depending on which side is exposed to the force of the wind.

U.S. Pat. No. 3,103,886 discloses a guide assembly for projectiles in which the two fin blades are each connected with a slide guide bearing and relatively complicated pressure members are additionally required to unfold the fins.

SUMMARY OF THE INVENTION

It is an object of the present invention to further develop a guide assembly of the above-mentioned type so that it has a simple and robust structure and the fins, when unfolded, are symmetrically arranged outside the jacket or periphery of the missile.

The above object is achieved according to the present invention by a guide assembly for projectiles and missiles of the type including a plurality of fins which are foldable and unfolded in the circumferential direction, with each fin comprising two fin blades whose tips are connected with one another and whose roots are fastened to respective separate bearings which are mounted on the guide assembly and whose circumferential spacing is variable such that the two fin blades, in the unfolded state of a respective fin, are arranged in the manner of a peaked roof; and the bearings are comprised of an articulated fixed bearing and an articulated slide guide bearing, with the slide guide bearing being disposed so as to move between first and second end positions, corresponding to the folded and unfolded states of a fin, in a groove which extends in the circumferential direction; the first position is disposed adjacent the fixed bearing such that, in the folded state of a fin, the respective fixed and slide guide bearings of a fin are arranged one behind the other in the circumferential direction; the groove extends between the first and second positions such that with increasing distance from the said fixed bearing, the groove has an ever greater radial distance from the longitudinal center axis of the missile; and the second position is disposed such that, in the unfolded state of the fin, the portions of the respective fin blades which are outside of the peripheral surface of the missile have a symmetrical configuration relative to the fin axis of the respective fin.

The invention will be described in greater detail below with reference to an embodiment and the drawing figures.

DETAILED DESCRIPTION OF THE PREFERRED EMBODIMENT

Figure 1:
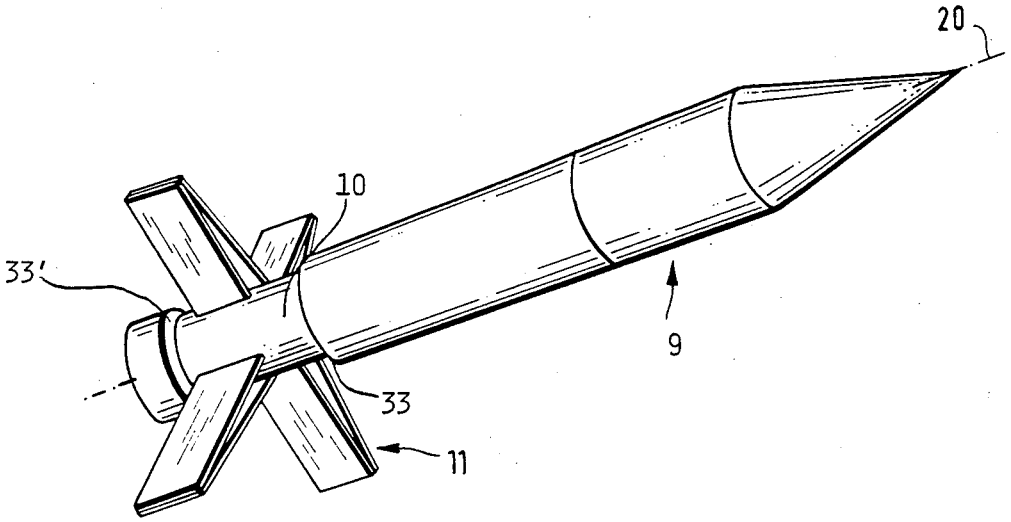
FIG. 1 is a perspective, highly schematic illustration of a missile having a guide assembly which includes a plurality of unfoldable fins.

FIG. 1 is a schematic perspective view of a missile 9 having a guide assembly 10 including a plurality of unfoldable fins 11 arranged in the tail section of the missile, the center or longitudinal axis of the missile and guide assembly being marked 20. Missiles of this type and also projectiles are fired, for example packed within a carrier projectile, from launchers or large caliber tubular weapons and are intended to be ejected from the carrier projectile at a large distance where they are to reach target points with the greatest possible precision.

To stabilize the trajectory and/or provide end phase guidance after ejection from the carrier projectile, a guide assembly 10 is required which should have the best possible aerodynamic characteristics but should also be robust and compact to be able, on the one hand, to withstand high acceleration stresses as they occur particularly when such projectiles are fired from tubular weapons and, on the other hand, should take up the smallest possible amount of the volume provided for the payload in the missile/projectile.

Figure 2:
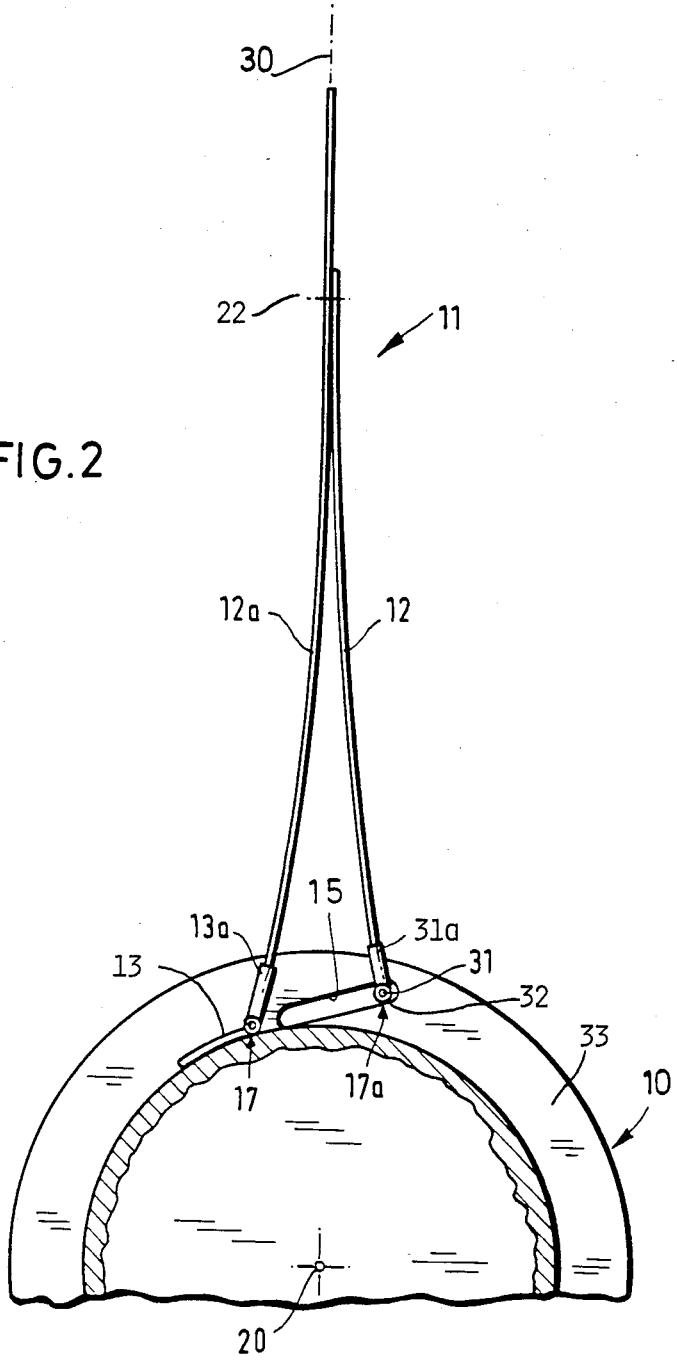
FIG. 2 is a cross-sectional view of part of the missile of FIG. 1 seen in the direction toward the side edges of one guide assembly fin according to the invention in its unfolded state.

FIG. 2 is an enlarged cross-sectional view of part of the missile 9 of FIG. 1 as seen toward the side edges of a fin 11 of the guide assembly 10. Fin 11 is composed of two fin blades 12, 12*a*, which are connected together at their tips, for example by riveting or electron beam welding, and whose roots are fastened to separate bearings 17, 17*a* which are mounted on the guide assembly and whose circumferential spacing can be varied so that, in the unfolded state of fin 11 as shown in FIG. 2, fin blades 12, 12*a* form an invented V or peaked roof-like structure.

Fin blades 12, 12*a* themselves are made of an elastic and flexible material, such as, for example, spring steel, a high strength light metal alloy or a fiber reinforced plastic, which facilitates their collapsing and accommodation in the body of missile 9. However, fins 11 form a very stable arrangement in the unfolded state shown in FIG. 2 with excellent aerodynamic characteristics.

One of the bearings 17, 17*a*, i.e., the bearing 17 in the illustrated embodiment, is an articulated fixed bearing, e.g. a hinge having one member 13 fixedly connected to a depressed peripheral surface portion of the missile and its other member 13*a* connected to the root of the blade 12*a*. The other bearing 17*a* is an articulated slide guide bearing. For example, the bearing 17*a* may, as shown, include a member 31*a* connected to the root of the blade 12 and to an axle or shaft 31 whose ends are provided with respective rollers 32 (only one of which can be seen in FIG. 2) which ride in respective grooves 15 (only one of which can be seen in FIG. 2) formed in respective parallel radially extending side walls 33, 33' (FIG. 1) provided in the missile periphery, in the manner generally disclosed in the above mentioned International patent publication. It is to be understood that the showing in FIG. 1 is highly schematic and that in a missile containing a bearing arrangement as just described the leading and trailing edges of the fin blades and the ends of the respective bearings would extend substantially to each of the walls 33, 33'. This type of bearing arrangement makes it possible, as shown in detail in FIG. 3, to accommodate the fins 11 in the circumferential region of missile 9 in a space saving manner secure for firing, in that fin blades 12, 12*a*, when folded or collapsed, are wound round missile 9 in the circumferential direction. The jacket 16 of the carrier projectile holds the fins 11 in the folded position until missile 9 has been ejected from the carrier projectile, generally in the axial direction.

Figure 3:
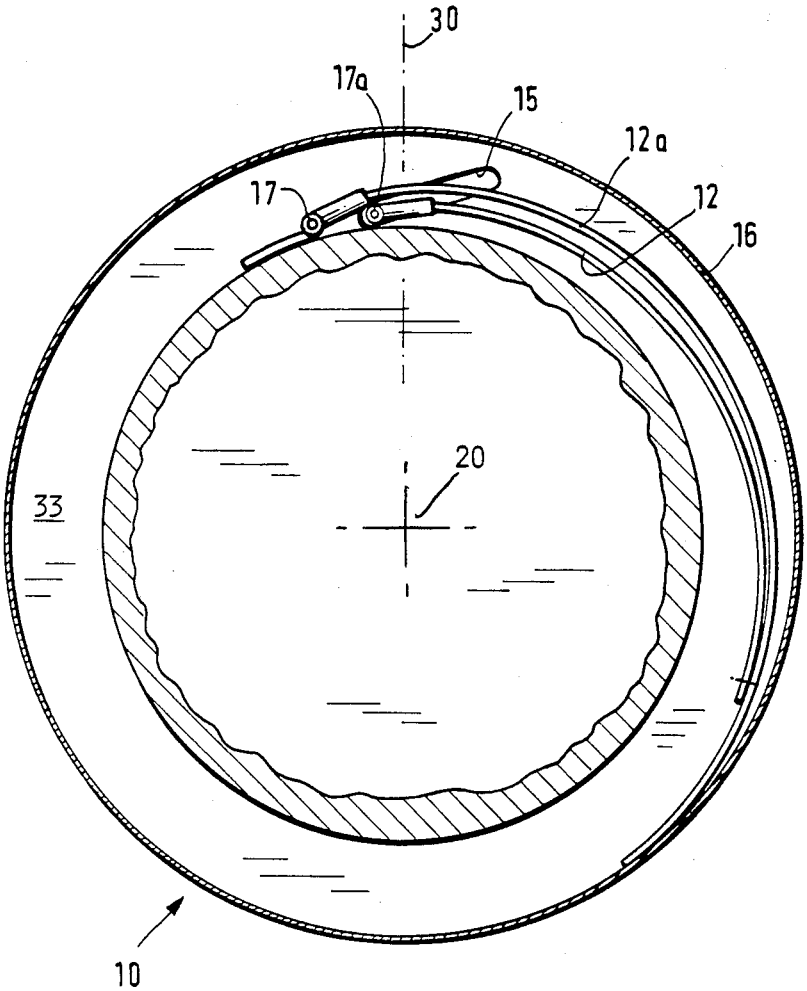
FIG. 3 is a cross-sectional view of the missile similar to that of FIG. 2 but with the fin collapsed or folded.

In the collapsed or folded state of the fins 11 as shown in FIG. 3, fin blades 12 and 12*a* of each fin 11 (for the sake of clarity, only one fin 11 is shown) lie in close proximity on top of one another. This is accomplished in that the groove 15 is formed such that in one of its end positions the slide guide bearing 17*a* is disposed, in the circumferential direction of the missile, immediately next to the articulated fixed bearing 17 of the respective fin 11. In this embodiment, fins 11 may also be designed to be comparatively long, when seen in the radial direction, for example by extending the length of the blade 12*a* beyond the point 22 where its tip is connected to the tip of blade 12, and thus to optimally meet aerodynamic requirements, since even such long fins can still be accommodated in a space saving manner. The fin blades 12, 12*a* of a fin 11 then cover at least the bearing region of the adjacent fin (not shown in FIG. 3).

In the unfolded state according to FIG. 2, bearings 17, 17*a* of fin blades 12*a* and 12, respectively, are spaced from one another in the circumferential direction so that the illustrated peaked roof-like arrangement of fin blades 12, 12*a* results. This peaked position is attained by fin blades 12, 12*a* because the articulated slide guide bearing 17*a* moves away from fixed bearing 17*a* along groove 15 when the fin 11 unfolds.

As indicated above, in the known fin arrangements of this general type, the groove 15, or other guide for the slide bearing, extends concentrically to the central axis 20 of the missile. If the groove 15 has one end position adjacent the fixed bearing 17 as shown in FIGS. 2 and 3 so that the two bearings are in front of one another in the circumferential direction when the fin is folded, then in order to be able to fold the fins without damaging same, the fin blade attached to one of the bearings 17, generally the slide guide bearing 17 as shown, must be of a shorter length than the fin blade connected to the other bearing, as measured from the respective bearing to the point 22 where the blade tips are connected together. However, when a fin 11 constructed in this manner is unfolded, it is asymmetrical with respect to the fin axis 30, i.e., it tends to lean or be inclined toward the side with the shorter blade length. In order to avoid this problem, according to the invention the groove 15 for the slide guide bearing 17*a* is oriented or inclined such that, with increasing circumferential distance from the fixed bearing 17, the slide guide bearing 17*a* will have an ever greater radial distance from the center or longitudinal axis 20 of the missile. The length of the groove 15 and the degree of inclination are such that, after unfolding and when the bearing 17*a* is in the end position of the groove 15 as shown in FIG. 2, the portions of the fin blades 12, 12*a* outside of the peripheral surface of the missile 9 have a symmetrical configuration relative to the respective fin axis 30.

The present disolosure relates to the subject matter disclosed in Federal Republic of Germany application No. P 36 18 958.8 filed June 5th, 1986, the entire specification of which is incorporated herein by reference.

It will be understood that the above description of the present invention is susceptible to various modifications, changes and adaptations, and the same are intended to be comprehended within the meaning and range of equivalents of the appended claims.

What is claimed is:

1. In a guide assembly for projectiles and missiles, said guide assembly including a plurality of fins which are foldable and unfolded in the circumferential direction, with each fin comprising two fin blades whose tips are connected with one another and whose roots are fastened to respective separate bearings which are mounted on said guide assembly and whose circumferential spacing is variable such that said two fin blades, in the unfolded state of a respective said fin, are arranged in the manner of a peaked roof, and wherein said bearings are comprised of an articulated fixed bearing and an articulated slide guide bearing, with said slide guide bearing being disposed so as to move between first and second end positions, corresponding to the folded and unfolded states of said fin, in a groove which extends in the circumferential direction; the improvement wherein: said first position is disposed adjacent said fixed bearing such that, in the folded state of a fin, the respective said fixed and slide guide bearings of a fin are arranged one behind the other in the circumferential direction; said groove extends between said first and second positions such that with increasing distance from said fixed bearing, said groove has an ever greater radial distance from the longitudinal center axis of the missile; and said second position is disposed such that, in the unfolded state of the fin, the portions of the respective said fin blades which are outside of the peripheral surface of the missile have a symmetrical configuration relative to the fin axis of the respective said fin.

2. A guide assembly as defined in claim 1 wherein the length of the one of said two fin blades connected to said slide guide bearing between its said root and the point whereat its tip is connected to the other of said two fin blades is less than the corresponding length of said other of said two fin blades.

3. A guide assembly as defined in claim 1 wherein a portion of the tip of one of said two blades extends radially outwardly beyond the point whereat said one blade is connected to the tip of the other of said two blades when the respective fin is in the unfolded state.

* * * * *